United States Patent [19]

Sakashita

[11] Patent Number: 4,683,794

[45] Date of Patent: Aug. 4, 1987

[54] AUTOMATIC MUSIC PLAYING APPARATUS CAPABLE OF PRODUCING A PLURALITY OF DIFFERENT SOUNDS SIMULTANEOUSLY

[75] Inventor: Shigeo Sakashita, Tokyo, Japan

[73] Assignee: Casio Computer Co., Ltd., Tokyo, Japan

[21] Appl. No.: 814,630

[22] Filed: Dec. 30, 1985

[30] Foreign Application Priority Data

Jan. 19, 1985 [JP] Japan ..... 60-7871

[51] Int. Cl.[4] ..... G10H 1/42; G10H 7/00

[52] U.S. Cl. ..... 84/1.03; 84/DIG. 10; 84/DIG. 12

[58] Field of Search ..... 84/1.01, 1.03, DIG. 10, 84/DIG. 12

[56] References Cited

U.S. PATENT DOCUMENTS 4,328,732 5/1982 Takeda et al. ..... 84/1.03 X
4,355,559 10/1982 Uya et al. ..... 84/1.03
4,356,752 11/1982 Suzuki et al. ..... 84/1.03
4,357,854 11/1982 Hirano .
4,534,257 8/1985 Mitarai ..... 84/1.03

FOREIGN PATENT DOCUMENTS 2910472 9/1979 Fed. Rep. of Germany .

*Primary Examiner*—S. J. Witkowski
*Attorney, Agent, or Firm*—Frishauf, Holtz, Goodman and Woodward

[57] ABSTRACT

A plurality of rhythm designation data are supplied from a CPU, and latched in corresponding individual latches which are responsive to channel data from a decoder. The latched data are supplied to an address ROM in response to corresponding channel timing signals, wherein start and end address data for a rhythm waveform data ROM are read out from the address ROM. If the rhythm designation data latched in one of the individual latches is the same as in another one of the latches, the same rhythm is sounded concurrently and without sound interruption.

13 Claims, 7 Drawing Figures

AUTOMATIC MUSIC PLAYING APPARATUS CAPABLE OF PRODUCING A PLURALITY OF DIFFERENT SOUNDS SIMULTANEOUSLY

BACKGROUND OF THE INVENTION

This invention relates to an automatic music playing apparatus, which produces musical sounds by reading out previously stored musical sound waveform data.

There has been provided an automatic music playing apparatus, in which a plurality of musical sound waveform data are previously stored and are read out on a time division basis at successive sound generation timings of also previously stored performance pattern data.

In this prior art automatic music playing apparatus, musical sound waveform data of a timbre is processed in a channel which is allotted to this timbre. Therefore, if a command for producing a next musical sound of the same timbre is produced before the end of generation of the preceding musical sound, the preceding musical sound is interrupted, and the next musical sound immediately starts to be generated. In such a case, it is felt that an interruption of a musical sound has occurred, that is, smooth music performance can not be obtained. In addition, channels corresponding in number to the number of the timbres or stored musical sound waveform data are required for processing on the time division basis, leading to complex of circuitry and cost increase.

SUMMARY OF THE INVENTION

An object of the invention is to provide an automatic music playing apparatus, which permits smooth music performance free from interruption of sounds to be obtained even if commands for generating musical sounds of the same timbre are provided consecutively, and has circuitry which is simple and constructed at low cost.

According to the invention, there is provided an automatic music playing apparatus, which comprises musical sound waveform data memory means for storing a plurality of musical sound waveform data, musical sound waveform data designating means for simultaneously designating a plurality of musical sound waveform data among musical sound waveform data stored in said musical sound waveform data memory means, channel allotting means for allotting a musical sound generation channel selectively for each of the plurality of musical sound waveform data designated by said musical sound waveform data designating means, address designating means for designating, whenever a channel is allotted by said channel allotting means, the start and end addresses of an area of said musical sound waveform data memory means where the musical sound waveform data concerning the allotted channel is stored, musical sound waveform data reading means for reading out musical sound waveform data between the start and end addresses designated by said address designating means, and musical sound output means for converting musical sound waveform data read out by said musical sound waveform data reading means into a musical sound signal.

With the automatic music playing apparatus according to the invention, channels are allotted by switching to musical sounds to be generated without regard to the kinds the musical sounds, so that sound interruption can be eliminated.

DETAILED DESCRIPTION OF THE PREFERRED EMBODIMENT

Now, an embodiment of the invention will be described in detail with reference to the drawings. In this embodiment, four channels are provided for operation on a time division basis. The same rhythm designation data or different rhythm designation data may be set for these four channels. In this case, it is possible to select and set one of 16 rhythms of different timbres at the most. Particularly, when the same rhythm designation data are set in at least two of the four channels, the same rhythms can be produced concurrently, and a sound interruption as in the prior art apparatus will not occur.

Figure 1A:
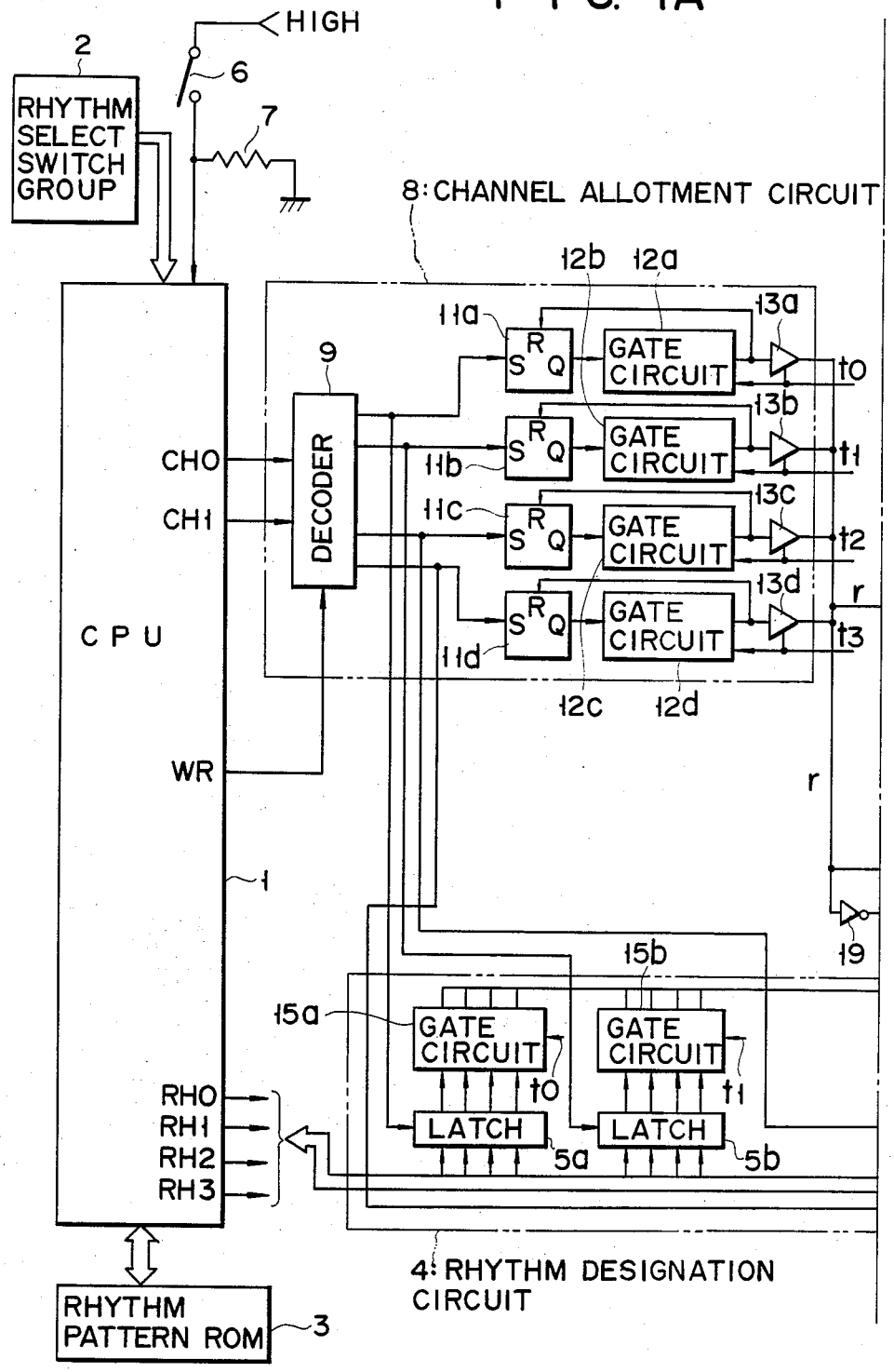
FIGS. 1A and 1B constitute a block diagram showing an embodiment of the automatic music playing apparatus according to the invention.
Figure 1B:
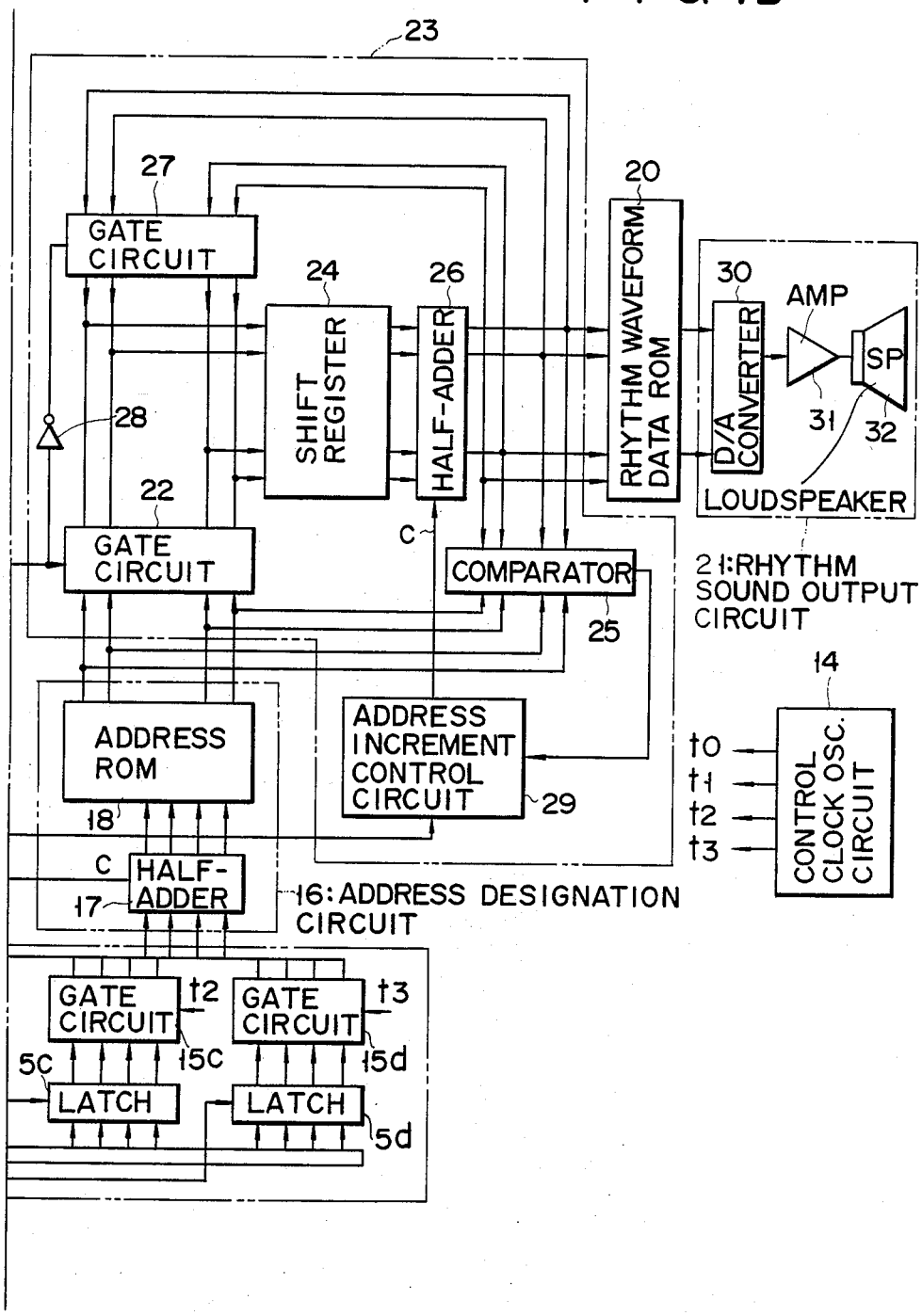

Referring to FIGS. 1A and 1B, CPU 1 controls the operation of the entire embodiment.

First, the structure for designating rhythms will be described.

Rhythm designation data from rhythm select switch group 2 is supplied to CPU 1. Rhythm select switch group 2 can simultaneously select at most four different timbres for the individual four channels. Rhythm pattern ROM 3 for providing rhythm pattern data according to supplied rhythm designation data is connected to CPU 1. Rhythm pattern ROM 3 provides 16 different 4-bit rhythm data RH0 to RH3 of "0000(0)" to "1111(15)" at each rhythm pattern sound generation timing according to address designation from CPU 1. These data are fed as parallel data to latches 5*a* to 5*d* in rhythm designation circuit 4. Rhythm start and stop commands are given from a start/stop designation circuit consisting of switch 6 and resistor 7 to CPU 1.

CPU 1 provides, simultaneously with rhythm data RH0 to RH3, 2-bit channel data CH0 and CH1 of "00(0)" to "11(3)" representing the number of channels, to which the rhythm data are to be allotted. Channel data CH0 and CH1 are fed to decoder 9 in channel allotment circuit 8. Decoder 9 is driven by drive signal WR provided from CPU 1 to decode channel data CH0 and CH1 into 4 different 4-bit channel allotment data of "0001", "0010", "0100" and "1000". Of the channel allotment data obtained in this way, any bit of "1" is fed progressively as a latch designation signal to latches 5*a* to 5*d* at each channel allotment timing. Rhythm data RH0 to RH3 are latched in latches 5*a* to 5*d* at each timing, at which a latch command of "1" is given.

Figure 5:
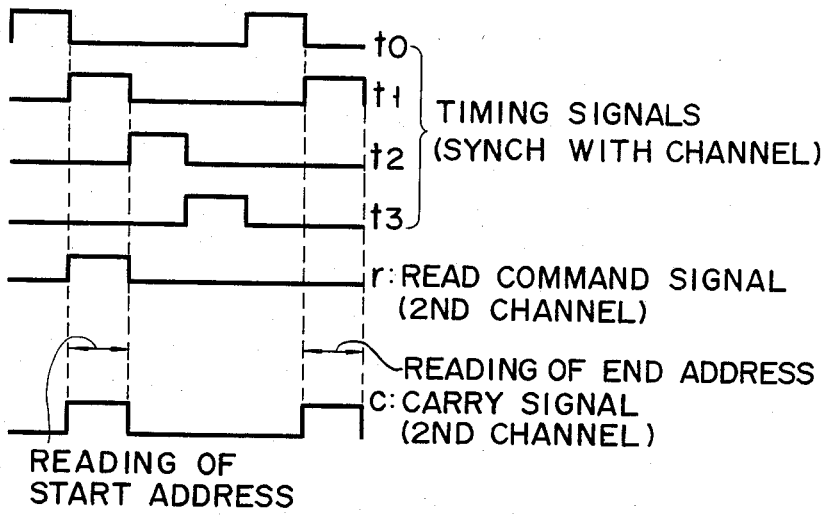
FIG. 5 is a time chart showing signals in various components shown in FIGS. 1A and 1B.

A bit output of "1" among the 4-bit channel allotment data provided from decoder 9 is fed as a set signal S to SR flip-flops 11*a* to 11*d*. Q outputs of flip-flops 11*a* to 11*d* are fed through gates 12*a* to 12*d* back to flip-flops 11*a* to 11*d* as a reset signal R. Also, they are provided through gates 12*a* to 12*d* and 13*a* to 13*d* as a common read command signal r. Gates 12*a* to 12*d* and 13*a* to 13*d* are controlled such that they are enabled when timing signals t0 to t3 provided form control clock oscillation circuit 14, as shown in FIG. 5, are "high". Timing signals t0 to t3 are synchronized to the channel period of the respective four channels for time division basis operation. Thus, read command signal r is provided for each channel timing.

Timing signals t0 to t3 are fed as gate enable signals to gates 15*a* to 15*d* in rhythm designation circuit 4, whereby rhythm data that have been latched in latches 5*a* to 5*d* are fed as address signals through half-adder 17 to address ROM 18 in address designation circuit 16 at corresponding timings. Read command signal r is inverted by inverter 19 to produce a signal $\bar{r}$, which is fed as a carry signal to half-adder 17.

The structure of address designation circuit 16 will now be described.

Read command signal r provided from channel allotment circuit 8 is inverted by inverter 19 before being fed to half-adder 17. During the presence of read command signal r, i.e., during any channel allotment period, therefore, half adder 17 performs no addition operation, and rhythm data RH0 to RH3 latched in latches 5*a* to 5*d* are fed as such as address signals to address ROM 18.

Figure 2:
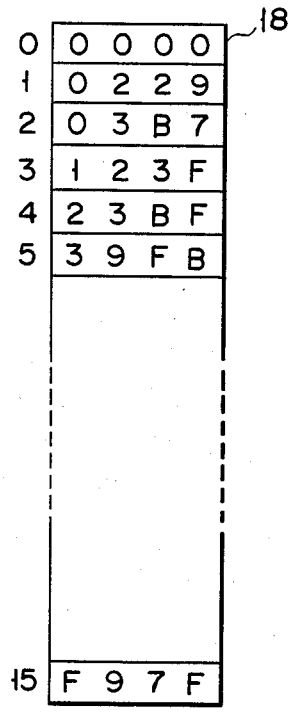
FIG. 2 is a view showing the contents of an address ROM in FIG. 1B.

Waveform data for 16 different rhythms are stored in rhythm waveform data ROM 20 which is connected as a preceding stage to rhythm sound output circuit 21. The start addresses of the storage areas where 16 waveform data noted above are stored are set in address ROM 18. Rhythm data RH0 to RH3 obtained through half-adder 17 are fed as address signals to address ROM 18, and start address data of corresponding rhythm waveform data is read out from address ROM 18. The start address data thus read out is fed through gate circuit 22 to shift register 24 in rhythm waveform data read circuit 23 and set therein. Gate circuit 22 is enabled when read command signal r is provided from channel allotment circuit 8. In this embodiment, end address data for ROM 20, of the rhythm waveform data concerning the start address data read out from address ROM 18, is set equal to the next start address data stored in ROM 18 concerning the next rhythm. The end address data, i.e., "0229", is read out when rhythm data RH0 to RH3 that are provided from half adder 17 after start address data "0000" shown in FIG. 2 is read out from address ROM 18 are given after incrementation by +1 to address ROM 18. The +1 incrementation operation of half-adder 17 is done when a high level carry signal is fed to half-adder 17 with the inversion of read command signal r to low level with the output of the next timing signal. When the next read command signal r is "high", half-adder 17 does not effect any +1 incrementation operation, and the output of half-adder 17 is used as such for the reading of the start address data for the next rhythm. The end address data read out from ROM 18 is fed to one of input terminals of comparator 25.

The structure of a rhythm waveform data read section and rhythm sound output section will now be described.

Shift register 24 consists of four parallel 16-bit shift registers. It is thus possible to set start address data for rhythms for the four channels in shift register 24. The start address data for each channel is fed as address data through half-adder 26 to rhythm waveform data ROM 20, and is also fed back to shift register 24 through gate circuit 27. Gate circuit 27 receives inverted read command signal $\bar{r}$ obtained from inverter 28. Thus, it is disabled when gate circuit 22 is enabled and enabled when gate circuit 22 is disabled. When a half-adder 26 is given a carry signal from an address incrementation control circuit 29, which is set by read command signal r, a +1 incremented address signal is fed to rhythm waveform data ROM 20. The detailed operation of address incrementation control circuit 29 will be described later. It will be understood that as the start address data fed through gate circuit 22 to shift register 24 is circulated through shift register 24, half adder 26 and gate circuit 27, it is progressively incremented in half-adder 26 to be fed as address data to rhythm waveform data ROM 20.

The waveform data stored in rhythm waveform data ROM 20 is PCM data obtained through coding of values obtained by time-division basis sampling of waveforms of 16 different rhythms, e.g., bass drum, snare drum, high conga, etc. The waveform data read out from a corresponding memory area of rhythm waveform data ROM 20 is converted in D/A converter 30 in rhythm sound output circuit 21 into an analog signal, which is amplified by amplifier 31 to be sounded from loudspeaker 32.

When first start address data "0000" is provided from address ROM 18 and fed through gate circuit 22 to shift register 24, the output of half-adder 26 is incremented by +1 every time carry signal C is provided from address incrementation control circuit 29 as noted above, and the incremented data being is fed to the other input terminal of comparator 25. Address ROM 18 provides the start address data of a corresponding area of ROM 20 only when address data corresponding to selected rhythm waveform data is provided for the first time from half-adder 17. Subsequently, address ROM 18 provides the end address data of the corresponding area every time half-adder 17 effects +1 incrementation. The end address data is fed to one input terminal of comparator 25. Therefore, when the end address data of the pertinent rhythm waveform data is provided from half-adder 26, comparator 25 provides a coincidence signal to reset address incrementation control circuit 29. When address incrementation control circuit 29 is reset, no carry signal is fed to half-adder 26, so that the end address data is held as such for address data fed from half-adder 26 to ROM 20. The waveform data for rhythm read out according to the end address data is "0", so that the condition when the sounding of rhythm is over, is held.

The structure of address incrementation control circuit 29 will now be described with reference to FIG. 4.

Figure 4:
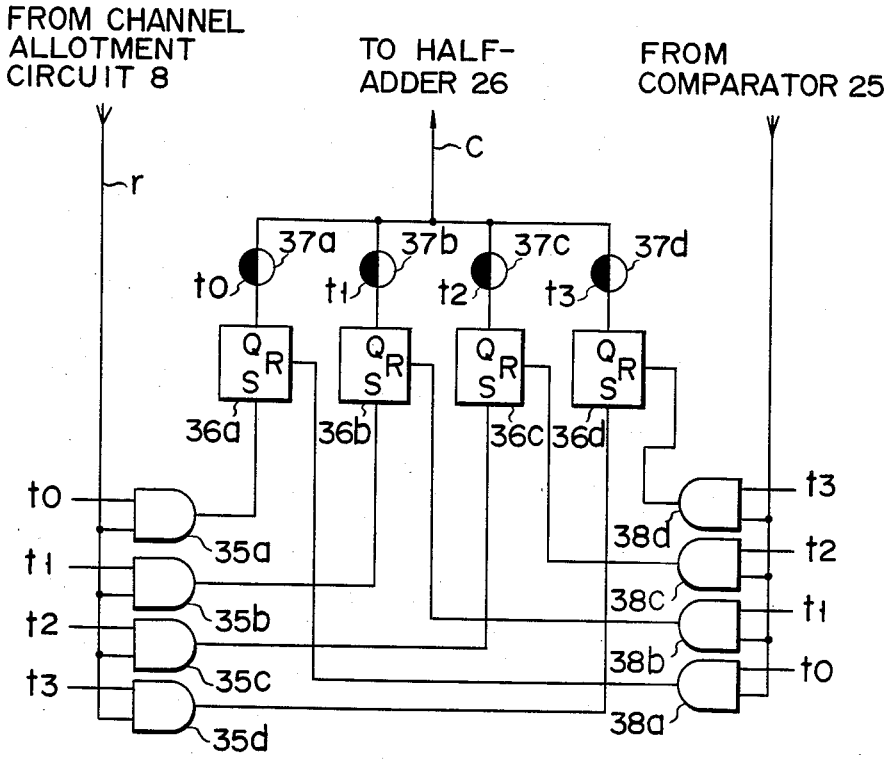
FIG. 4 is a schematic representation of an address incrementation control circuit shown in FIG. 1B.

Referring to FIG. 4, a read command signal r supplied as a set signal from channel allotment circuit 8, is commonly fed to AND gates 35*a* to 35*d*, which are enabled by timing signals t0 to t3 shown in FIG. 5. The outputs of AND gates 35*a* to 35*d* are fed as a set signal to SR flip-flops 36*a* to 36*d*. Q outputs of flip-flops 36*a* to 36*d* are fed as carry signals to half-adder 26 through transfer gates 37*a* to 37*d* which are enabled by timing signals t0 to t3. In this way, incrementation control from start to end address of data ROM 20 for the rhythm to be sounded is effected. Flip-flops 36*a* to 36*d* correspond to the respective channels, and the incrementation control of address data of ROM 20 is done for each of the rhythms for which channels are allotted.

When the address data for reading rhythm waveform data coincides with the end address data, comparator 25 provides a coincidence signal, which is fed to one input terminal of each of AND gates 38*a* to 38*d*. Timing signals t0 to t3 are fed to the other input terminal of respective AND gates 38*a* to 38*d*. As a result, the reset signal is fed through AND gates 38*a* to 38*d* to flip-flops 36*a* to 36*d*. The incrementation of the address data for reading the rhythm waveform data is stopped when all the timing signals t0 to t3 have been given.

Figure 6:
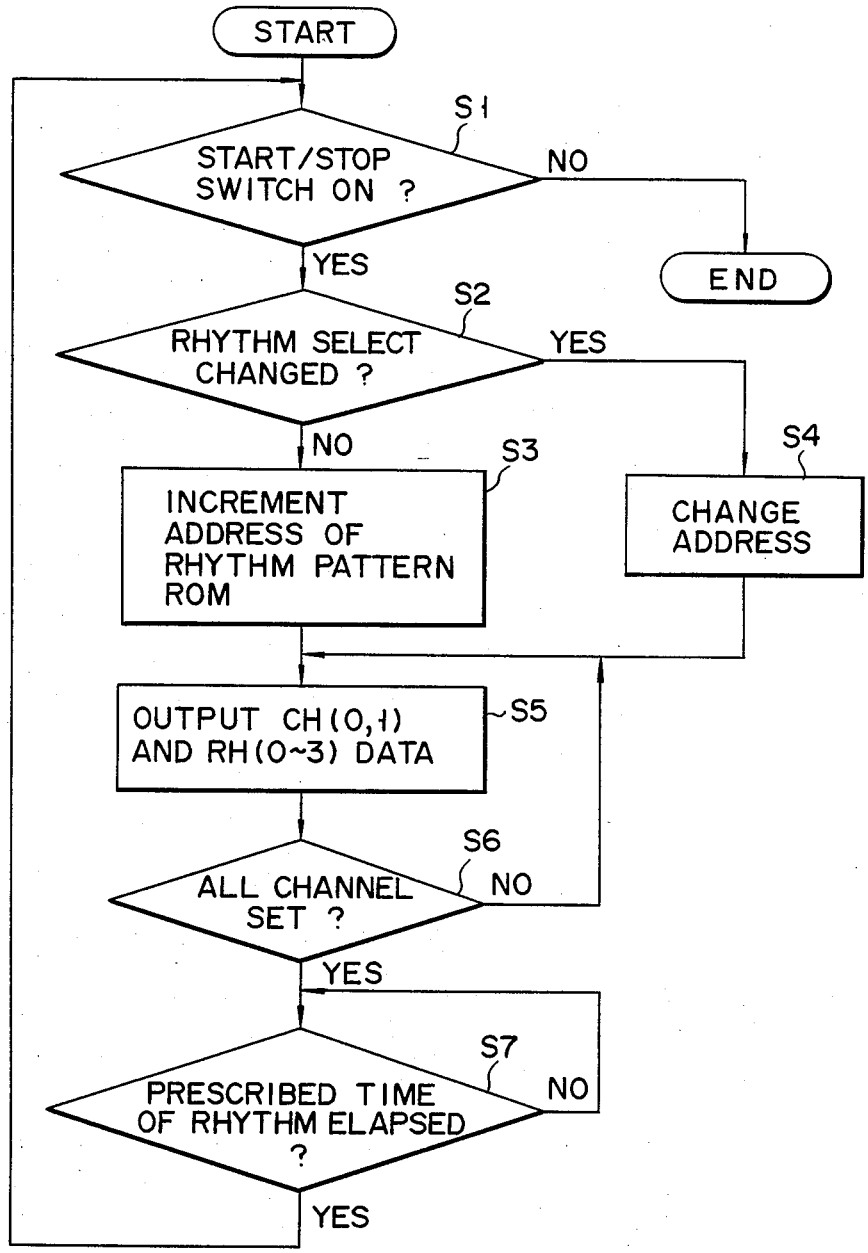
FIG. 6 is a flow chart for explaining the operation of a CPU in FIG. 1A.

The operation of the embodiment shown in FIGS. 1A and 1B will now be described with reference to the flow chart of FIG. 6.

First, a check is done in step S1 as to whether start/-stop switch 6 is "on". If the result of the check is NO, i.e., if start/stop switch 6 is "off", no rhythm generation operation is performed. When switch 6 is "on", step S2 is executed, in which a check is done as to whether the rhythm select state has been changed by operating rhythm select switch group 2. It is assumed that a rhythm pattern consisting of the rhythms of bass drum, high conga and claves has been specified by switch group 2. If it is not detected in step S2 that the rhythm select state has not been changed, step S3 is executed, in which the address of the pertinent rhythm pattern data in ROM 3 is incremented to the next address. If it is detected in step S2 that the rhythm select state has been changed, step S4 is executed, in which the address of ROM 3 is changed according to the changed rhythm.

When the rhythm select state is not changed and the initially designated rhythm pattern data is continuously read out, channel data CH0 and CH1 and rhythm data RH0 to RH3 are provided from CPU 1 in step S5 at the timings of the rhythm pattern read out from ROM 3.

For example, a pattern is assumed, in which high conga, bass drum, claves and bass drum are provided as respective rhythm generation timings and then bass drum is continually sounded. CPU 1 provides channel data CH0 and CH1 of "00", "01", "10" and "11" and rhythm data RH0 to RH3 of "0010", "0000", "1111" and "0000" at each rhythm generation timing to decoder 9 in channel allotment circuit 8 and latches 5*a* to 5*d* in rhythm designation circuit 4, respectively. Thus, high conga is allotted to the first channel, bass drum to the second channel, claves to the third channel and bass drum to the fourth channel. In step S6 a check is done as to whether the setting of all the channels is over. If the result of the check is YES, a step S7 of rhythm sounding is executed.

In this case for the first channel for high conga, rhythm data "0010" thereof is latched at the rhythm generation timing in latch 5*a* under the control of a latch signal from decoder 9 to be fed through gate circuit 15*a* to half adder 17 at the timing of timing signal t0. At this time, read command signal r is provided from gate circuit 13*a* at the timing of rise of timing signal t0, so that no carry signal is provided to half-adder 17. The rhythm data "0010" fed to half-adder 17 is thus fed as such to address ROM 18.

Meanwhile, start address data "03B7" (hexadecimal value) of high conga is read out from address ROM 18 to be fed through gate circuit 22, which is enabled by read command signal r, to shift register 24 to be set in the first stage thereof. Flip-flop 36*a* in address incrementation control circuit 29 is set by read command signal r. Subsequently, therefore, transfer gate 37*a* is enabled to pass the carry signal to half adder 26 with the appearance of every timing signal t0 corresponding to the first channel.

When second timing signal t0 appears, start address data "03B7" is provided from shift register 24 to be fed through half-adder 26 to rhythm waveform data ROM 20. Thus, start address data of the waveform data of high conga stored in address "03B7" of ROM 20 is read out. The waveform data thus read out is converted in D/A converter 30 into an analog signal to be amplified by amplifier 31. Thus, the rhythm of high conga starts to be sounded from loudspeaker 32.

Figure 3:
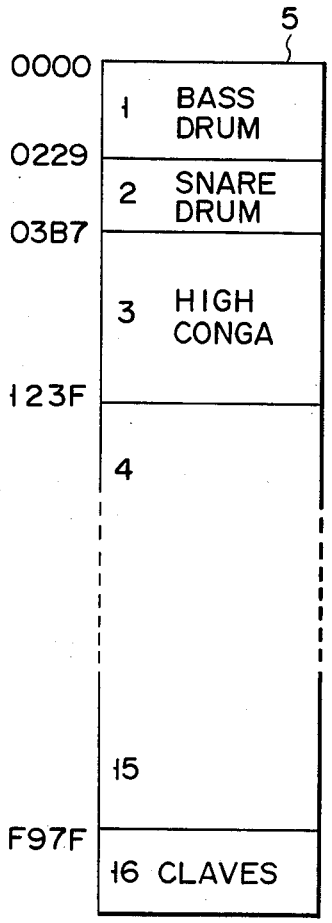
FIG. 3 is a view showing the contents of a rhythm waveform data ROM shown in FIG. 1B.

Subsequently, address data is circulated through gate circuit 27, shift register 24 and half-adder 26 at the timing of each timing signal t0, and half-adder 26 effects progressive incrementation of data from start address "03B7". In this way, the waveform data of high conga is read out from ROM 20 to be sounded. When the starting address data of high conga is read out from ROM 18, read command signal r concerning timing t0 becomes "0" with the resetting of flip-flop 11*a* in channel allotment circuit 8 caused by the feedback output of gate circuit 12*a*. Thus, the carry signal as the output of inverter 19 becomes "1" to cause the 'incrementation in half-adder 17. The rhythm data "0010" of high conga thus is incremented by 'to "0011". Thus, the end address data "123F" of high conga is read out from address ROM 18 (see FIGS. 2 and 3) to be fed to comparator 25.

Likewise, succeeding rhythm data "0000", "1111" and "0000" of bass drum, claves and bass drum are latched in latches 5*b* to 5*d* by respective timing signals t1 to t3, and the second to fourth channels are allotted. Start address data "0000", "F79F" and "0000" of the individual rhythms are set in shift register 24 at respective timings. In this way, the rhythms of bass drum, claves and bass drum are generated during the respective channel periods.

In this example, the second channel is allotted for the first bass drum, and the fourth channel for the second bass drum. Therefore, even if the second bass drum is generated before the vanishment of the first bass drum, the first bass drum will not be interrupted.

Further, in this embodiment, the incrementation of address data is stopped when the high conga data has been read out up to the end address and sounded in the first channel. Upon reaching of the isntant of generation of the next rhythm, the first channel is allotted to that rhythm. In this way, the first to fourth channels are allotted in the mentioned order irrespective of the timbre upon arrival of each instant of generation of new rhythm. Since the channels and timbres are not allotted in a fixed relation to one another, the necessary channels may be saved.

In the above embodiment, the start and end address of each rhythm waveform data are collectively stored in address ROM 18, so that it is possible to reduce the memory capacity. In addition, since the rhythm waveform data is stored in ROM 20 by the PCM system, high quality rhythm sounds can be generated.

Further, the rhythm waveform data may be stored in the pulse width modulation (PWM) system, pulse phase modulation (PPM) system, pulse number modulation (PNM) system and pulse amplitude modulation (PAM) system, etc. as well as the PCM system. It is further possible to increase or reduce the number of channels and kinds of rhythm timbres.

Further, ROMs 18 and 20 in FIGS. 1A and 1B may be replaced with RAMs. Moreover, it is possible to generate melody instead of rhythm as the musical sound. Further, voice, utterance of animals and other natural sounds or artificial sounds may be generated as the musical sound.

As has been described in the foregoing, according to the invention the available channels are switched for allotment to musical sounds to be generated, and without any relation to the kinds of musical sounds. Therefore, even if consecutive musical sounds of the same timbre are designated, preceding musical sound will never be interrupted by the succeeding musical sound, so that smooth music performance can be realized. In addition, a plurality of different musical sounds can be simultaneously generated with the same timbre. Further, since the channels are successively allotted independently of the kinds of timbres, there is no need for providing channels corresponding in number to the number of different kinds of timbres, so it is possible to provide a compact and inexpensive automatic music playing apparatus.

What is claimed is:

1. An automatic music playing apparatus, comprising:

waveform data memory means for storing a plurality of different waveform data, each of which represents a respective sound in digital form;

waveform data reading means arranged for operation on a time division basis over a plurality of associated channels, wherein different waveform data can be read out simultaneously by way of said channels from said waveform data memory means;

select means for enabling a user to select up to a certain number of the stored waveform data to be sounded simultaneously, said certain number corresponding to the number of said channels;

waveform designating means for providing waveform designation data to designate at least one of the stored waveform data for reading out from said waveform data memory means, in response to said select means;

channel allotting means coupled to said waveform designating means, for allotting said waveform designation data from said waveform designating means to selected ones of the channels associated with said waveform data reading means, including means for allotting more than one of said channels to the same stored waveform data when the same data is selected more than once by said select means; and sounding means for converting the waveform data read out from said waveform data memory means by way of said channels into musical sounds;

wherein the same stored waveform data can be sounded simultaneously by said sounding means without sound interruption when the same data is selected successively by the user.

2. The apparatus according to claim 1, including:

performance pattern memory means for storing a plurality of performance pattern data representing a performance pattern where a plurality of musical sounds are combined; and performance pattern reading means for selectively reading out one of said performance pattern data;

wherein said waveform designation data is designated to produce the musical sounds in accordance with the read-out performance pattern data.

3. The apparatus according to claim 2, wherein:

said performance pattern memory means includes means for storing a plurality of rhythm pattern data;

said select means includes a plurality of rhythm select switches; and said waveform designation means includes means for reading out a selected rhythm pattern data from said performance pattern memory means to successively designate the waveform designation data.

4. The apparatus according to claim 1, wherein said waveform designation means includes temporary storing means with an input terminal arranged to receive said plurality of waveform designation data, for temporarily storing waveform designation data when progressively enabled by a channel data from said channel allotting means.

5. The apparatus according to claim 4, wherein said waveform data reading means includes:

means for taking out the waveform designation data stored in said temporary storing means in time periods associated with the corresponding channels;

address designating means for receiving the taken-out waveform designation data and for designating corresponding start and end addresses of an area of said waveform data memory means where the selected musical sound waveform data is stored; and means for reading out musical sound waveform data between the start and end addresses designated by said address designating means.

6. The apparatus according to claim 5, wherein said channel allotting means includes:

a plurality of flip-flop circuits corresponding in number to the number of the channels of the waveform data reading means and held set by a channel data for the time periods of the corresponding channels, and including set terminals and reset terminals;

first gate means for receiving the set outputs of said flip-flop circuits and held enabled to pass said set outputs during the corresponding channel periods;

means for feeding back the output of said first gate means to the reset terminal of the corresponding flip-flop circuit; and means for feeding said set outputs as a read command signal to said waveform data reading means.

7. The apparatus according to claim 6, wherein said address designating means includes:

a first half-adder for receiving the waveform designation data taken out from said temporarily storing means and also receiving as a carry-in signal an inverted signal obtained from said read command signal; and an address ROM for receiving the output data of said first half-adder as address data and providing the start and end addresses of said waveform data memory means.

8. The apparatus according to claim 7, wherein said musical sound waveform data reading means includes:

second gate means for receiving the start address data provided from said address ROM and enabled by said read command signal;

a shift register set with the start address data as passed through said second gate means;

a second half-adder for receiving the output of said shift register;

means for feeding the output of said second half-adder as the start address of the waveform data of the corresponding channel to said waveform data memory means;

means for progressively incrementing the start address data and feeding the incremented data as address data to said waveform data memory means; and comparing and disabling means for comparing said end address data and the output data of said second half-adder and disabling the carry signal fed to said second half-adder when the two data coincide.

9. The apparatus according to claim 8, wherein said comparing and disabling means includes:

a comparator for comparing said end address data and the output data of said second half-adder and providing a coincidence output when the two data coincide; and an address incrementation control circuit set by said read command signal to feed the carry-in signal to said second half-adder and reset by said data coincidence.

10. The apparatus according to claim 9, wherein said address incrementation control circuit includes:

a first AND gate group for passing said read command signal during each channel period;

a flip-flop group set by an output of said first AND gate group;

a transfer gate group for passing a set output of said flip-flop group as said carry-in signal during each channel period;

a second AND gate group for passing a coincidence output of said comparator during each channel period; and means for feeding an output of said second AND gate group as a reset output of said flip-flop group.

11. The apparatus according to claim 8, which further comprises feedback means including third gate means for feeding back an output of said second half-adder to an input terminal of said shift register, the output of said second half-adder being incremented by +1 every time a carry-in signal is fed to said second half-adder.

12. An automatic music playing apparatus, comprising:

musical sound waveform data memory means for storing a plurality of musical sound waveform data;

select means for enabling a user to select up to a certain number of the stored waveform data to be sounded simultaneously, said certain number corresponding to a number of associated sound generation channels;

musical sound waveform data designating means coupled to said select means for simultaneously designating a plurality of musical sound waveform data among the data stored in said musical sound waveform data memory means;

channel allotting means coupled to said waveform data designating means, for allotting one of said number of sound generation channels for each of the plurality of waveform data designated by said musical sound waveform data designating means, including means for allotting more than one of said channels to the same stored waveform data when the same data is selected more than once by said select means;

address designating means for designating, when a channel is allotted by said channel allotting means, the start and end addresses of an area of said musical sound waveform data memory means at which the musical sound waveform data associated with the allotted channel is stored;

musical sound waveform data reading means for reading out musical sound waveform data between the start and end addresses designated by said address designating means; and musical sound output means for converting musical sound waveform data read out by said musical sound waveform data reading means into a musical sound;

wherein the same stored waveform data can be sounded simultaneously by said sound output means without sound interruption when the same data is selected successively by the user.

13. An automatic music playing apparatus, comprising:

rhythm waveform data memory means for storing a plurality of rhythm waveform data;

select means for enabling a user to select up to a certain number of the stored waveform data to be sounded simultaneously, said certain number corresponding to a number of associated channels;

rhythm waveform data designating means coupled to said select means for simultaneously designating a plurality of rhythm waveform data among the data stored in said rhythm waveform data memory means;

channel allotting means coupled to said waveform data designating means for allotting one of said number of said rhythm generation channels for each of the plurality of waveform data designated by said rhythm waveform data designating means, including means for allotting more than one of said channels to the same stored waveform data when the same data is selected more than once by said select means;

address designating means for designating, when a channel is allotted by said channel allotting means, the start and end addresses of an area of said rhythm waveform data memory means at which the rhythm waveform data associated with the allotted channel is stored;

rhythm waveform data reading means for reading out rhythm waveform data between the start and end addresses designated by said address designating means; and rhythm output means for converting rhythm waveform data read out by said rhythm waveform data reading means into a musical sound;

wherein the same stored waveform data can be sounded simultaneously by said rhythm output means without interruption when the same data is selected successively by the user.

* * * * *